United States Patent [19]

Petrie

[11] 4,008,704

[45] Feb. 22, 1977

[54] UNIVERSALLY ADJUSTABLE FORCED AIR FIREPLACE HEATER

[76] Inventor: Henry W. Petrie, 5212 Pommeroy Drive, Fairfax, Va. 22030

[22] Filed: June 10, 1975

[21] Appl. No.: 585,656

[52] U.S. Cl. ..... 126/121; 126/131

[51] Int. Cl.[2] ..... F24B 7/02

[58] Field of Search ..... 126/121, 129, 131; 237/51

[56] References Cited

UNITED STATES PATENTS

| | | | |
|---|---|---|---|
| 1,313,085 | 8/1919 | Greene | 126/121 |
| 2,134,935 | 11/1938 | Winnett | 126/121 |
| 2,161,723 | 6/1939 | Rutland | 126/121 |
| 2,828,078 | 3/1958 | Snodgrass | 126/121 |
| 3,195,968 | 7/1965 | Freeman | 312/255 |
| 3,880,141 | 4/1975 | Abshear | 126/131 |
| 3,901,212 | 8/1975 | Stites | 126/165 |

FOREIGN PATENTS OR APPLICATIONS

| | | | |
|---|---|---|---|
| 1,144 | 3/1873 | United Kingdom | 126/131 |

*Primary Examiner*—John J. Camby
*Assistant Examiner*—Larry I. Schwartz

[57] ABSTRACT

A forced air fireplace heater is disclosed which can be easily installed into a variety of sizes of existing fireplaces. A substantially vertical plenum approximately as wide as the firebox is installed in the rear portion thereof. A forced air blower is connected to the lower portion of the plenum. A plurality of heat exchanger tubes are connected to outlet ports on the top of the plenum and extend forwardly from the plenum across the throat of the fireplace so as to direct forced air introduced by the blower and heated in the plenum and heat exchanger tubes, past the lintel of the fireplace and into the ambient. The heat exchanger tubes are pivotally mounted to the plenum and have an adjustable length so as to permit the assembly to be installed in a variety of fireplace sizes and to be adjusted so as to optimally extract waste heat from the combustion gases.

An alternate embodiment is disclosed which includes an adjustable air chamber suspended beneath the lintel of the fireplace to permit the heat exchanger tubes to be selectively placed so as to optimize air circulation.

12 Claims, 15 Drawing Figures

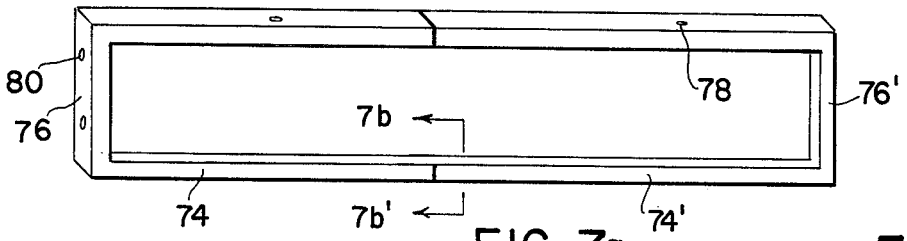
FIG. 7a
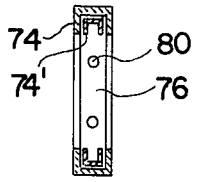
FIG 7 b
FIG 8 a
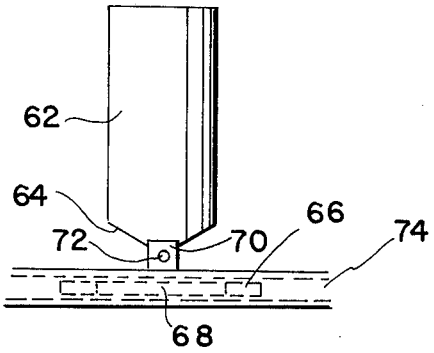
FIG 8 b
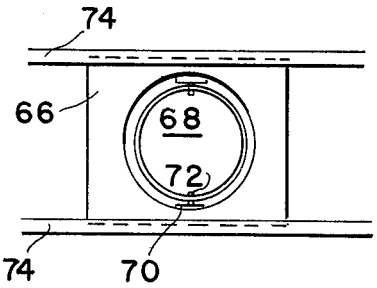
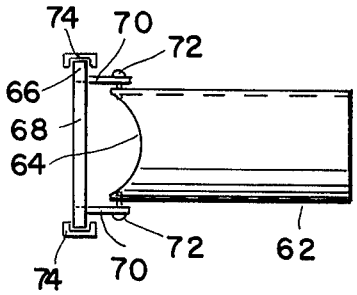
FIG 8c
FIG 10
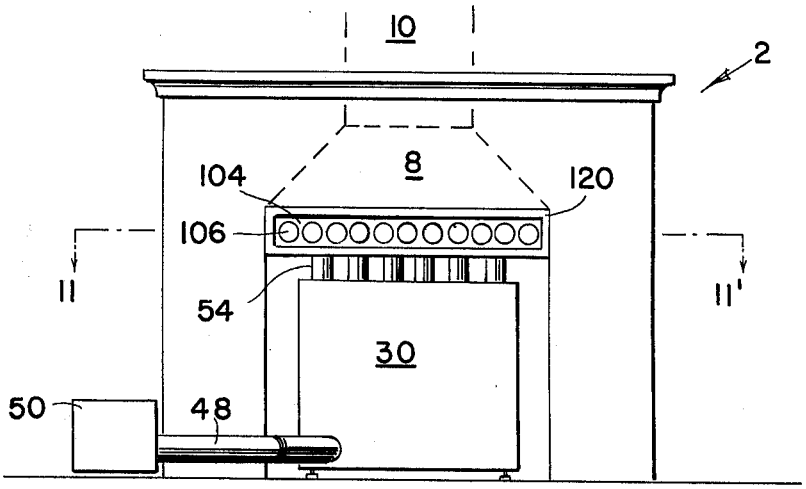

UNIVERSALLY ADJUSTABLE FORCED AIR FIREPLACE HEATER

FIELD OF THE INVENTION

The invention disclosed is generally directed to fireplace heaters and more particularly is directed to permanent forced air fireplace heaters.

BACKGROUND OF THE INVENTION

Historically, the fireplace was an important functional element of early houses in Europe and North America, serving as the principal source of heat for the room in which it was located. The conventional fireplace heats the ambient principally by radiative heating and therefore approximately 85% of the heat value of the fuel burned therein is wasted in the form of the combustion gases which are conducted out of the firebox before their heat content can be usefully extracted. The 20th century has seen the fireplace, as a functional heating element, supplanted by more efficient centralized heating systems burning fuel such as natural gas, oil, coal or electricity. Although the operational fireplace is retained in many homes being built today, it serves principally as an ornament, being put to use only on special occasions.

However, with the advent of a world wide scarcity in the fuels used in domestic, centralized heating systems, interest has been rekindled in making use of the erstwhile ornamental fireplace, as a functional element in the heating of the home. The importance of making the conventional domestic fireplace an efficient heating plant with a minimum investment of money and labor in the conversion thereof, can be appreciated.

Since the fireplace is so venerable a part of the household in the western hemisphere, work has been done in the prior art directed to the improvement in the efficiency thereof. For example, cumbersom superstructures, insertable into the firebox, have been developed which employ air convection principles to circulate air about the firebox and back into the ambient. These large structures are characterized by their difficulty of installation, their suitability for only a particular dimension of fireplace, their inefficient extraction of heat from combustion gases, and their constriction of the free flow of the gases into the flu. Access to the damper and throat of the fireplace for maintenance and cleaning is difficult. Other approaches to improving the heat efficiency of the conventional fireplace include the use of a small, roll-about heat exchanger assembly which can be rolled into the firebox and attached to a source of forced air. This type of heat exchanger apparatus fails to optimally extract heat from the combustion gases since it does not take advantage of the substantial amount of heat conducted and radiated rearwardly of the fire and the assembly lacks adjustment features to permit it to conform to the contours of the firebox, thereby making maximum use of the heat developed therein. Still other approaches have employed the use of a duct beneath the grating within the firebox for heating forced air conducted therethrough, by radiation. This type of apparatus is even more inefficient than those previously discussed, making no use of the substantial heat content of the combustion gases flowing up the throat of the fireplace.

OBJECTS OF THE INVENTION

It is an object of the invention to provide a fireplace heater which can be easily installed in a large variety of fireplace sizes.

It is another object of the invention to provide a fireplace heater which extracts heat from the combustion gases without unduly impeding the draft of the fireplace.

It is still another object of the invention to provide a fireplace heater which permits the selection of the direction for air heated thereby, in an improved manner.

It is yet a further object of the invention to provide a fireplace heater which efficiently extracts heat from the combustion gases thereof while permitting easy access to the damper mechanism of the fireplace.

It is still another object of the invention to provide a fireplace heater which permits easy installation in a variety of fireplace sizes having different lintel widths and firebox depths.

It is still a further object of the invention to provide a means for enhancing the heating efficiency of a fireplace, which can be installed by a homeowner without costly professional assistance.

SUMMARY OF THE INVENTION

These and other objects, features and advantages of the invention are accomplished by the universally adjustable, forced air fireplace heater disclosed herein. A substantially vertical plenum is located in the rear portion of the firebox, with a front surface approximately as wide as the firebox. The plenum has a top surface with a plurality of forced air egress ports. A forced air ingress port is located in the lower portion of the plenum. A forced air blower is connected to the ingress port for driving ambient air into the plenum. A plurality of heat exchanger tubes, each tube having a first end connected to one of the plurality of egress ports, extend forwardly from the plenum across the throat of the fireplace. The second end of the tube directs forced air out of the tube and past the lintel of the fireplace and into the ambient. The forced air introduced into the plenum by the blower is heated by conduction and radiation through the front surface of the plenum. The forced air is further heated in the heat exchanger tubes from the combustion gases in the throat of the fireplace. The heat exchanger tubes may be pivotally mounted on the egress ports of the plenum, providing for angular motion of the tube, about a substantially vertical axis so that the forced air may be directed out of the tube in a selected direction and access to the throat of the fireplace is permitted for adjustment of the fireplace damper or for maintenance where required. Coaxial sleeves slidably engage the heat exchanger tubes beneath the lintel so as to permit easy installation of the assembly into an existing fireplace having an arbitrary firebox depth. The pivotal mounting of the heat exchanger tubes on the plenum permits the tubes to be spread out across the throat of a firebox having an arbitrary width thereby making maximal use of the combustion gases in the throat thereof. Vertical adjustments to the position of the plenum may be made by means of threaded supports beneath the plenum. The cross sectional contour of the heat exchanger tubes is circular so as to minimize any impediment to the flow of the combustion gases in the throat of the fireplace consistent with optimally extracting waste heat therefrom.

An alternate embodiment is disclosed which includes an adjustable air chamber to be mounted beneath the lintel of the fireplace, having a plurality of holes on the back side thereof for receiving an adjustable sleeve communicating with the heat exchanger tube. The sleeve is in sliding engagement with the forward end of the heat exchanger tube. The sleeve can be withdrawn from one hole in the adjustable air chamber, the heat exchanger tube angularly displaced, and the sleeve then forwardly extended to the next hole in the chamber, thereby permitting the selective angular displacement of the heat exchanger tube for optimum air circulation in the room to be heated. The adjustable air chamber is comprised of two sliding portions, each having an equally spaced plurality of holes in the back portion thereof which can be juxtaposed upon installation of the chamber beneath the lintel of the fireplace, thereby permitting a single size air chamber unit to fit a variety of fireplace widths.

DESCRIPTION OF THE FIGURES

FIG. 7*a* is a more detailed illustration of the adjustable frame means mounted beneath the lintel.

FIG. 7*b* is a cross sectional view of the adjustable frame means of FIG. 7.

FIGS. 8*a*—8*c* is an orthoganal drawing illustrating the details of the sleeves and plate assembly.

FIG. 10 is a front elevational view of the alternate embodiment of the invention as placed in a fireplace.

DISCUSSION OF THE PREFERRED EMBODIMENT

Figure 1:
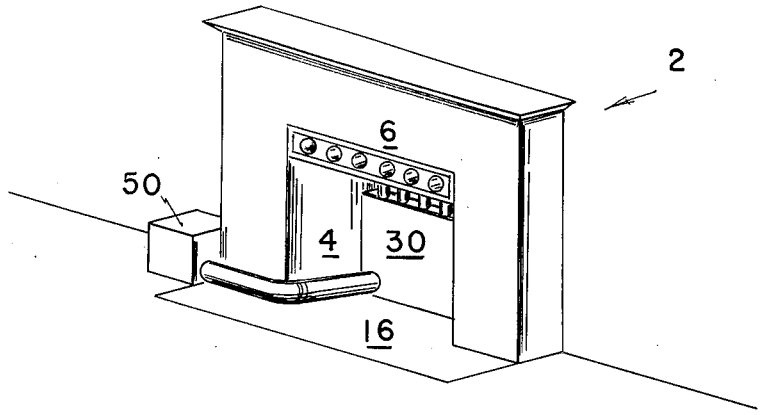
FIG. 1 shows an isometric view of the universal fireplace heater installed in a conventional fireplace.

FIG. 1 is an isometric view of a conventional fireplace 2 having a firebox 4 bounded by the hearth 16, the sidewalls 20 and 22 and the backwall 18. The face of the fireplace 2 above the firebox, is the lintel 6. Above the firebox 4 and within the fireplace is the throat 8 of the fireplace which communicates past the damper 12 into the flue 10. The damper 12 is controlled by the damper handle 14.

Figure 2:
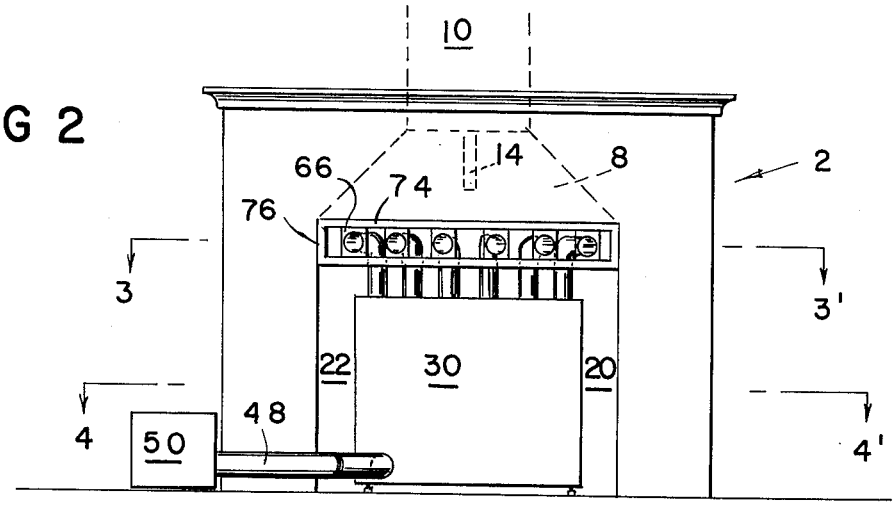
FIG. 2 is an elevational view of the universal fireplace heater.

The universal fireplace heater is shown in its relative position within the firebox 4 and generally comprises the plenum 30, the forced air blower 50, and the heat exchanger pipes 54. These elements are more particularly shown in the elevational view of FIG. 2.

The plenum 30 is a substantially vertical box located in the rear portion of the firebox 4. The plenum 30 is depicted in various views in FIGS. 2–6, and is generally bounded by the front surface 32, the top surface 34, the bottom surface 31, a back surface 33 and side surfaces 37 and 39, all of which are joined so as to form a gas tight seal. The composition of the plenum may be any heat resistant, thermally conductive material such as cast iron, sheet steel, copper or brass. The front surface 32 is to be transmissive to radiant heat produced by the fire in the firebox and therefore should be coated with a substance to enhance thermal emissivity of the surface, as for example black stove paint.

The lower portion of the front surface of the plenum 30 contains a forced air ingress opening 35 bounded by a nipple 36. The top surface 34 contains a plurality of forced air egress ports 38, each of which is bounded by a nipple 40. The interior of the plenum 30 is divided into a lower compartment 42 and an upper compartment 44, by a baffle attached to the back surface 33. Baffle 46 directs the flow of forced air from port 35, against the front surface 32 and into the upper chamber 44 from the lower chamber 42. There can be additional baffles 47 attached to back surface 33. The width of the plenum 30 in the horizontal direction parallel with the lintel 6 can be approximately the same width as the firebox 4. As will be seen later, a single minimum width can be chosen for the plenum 30, which will render the assembly suitable for any wider width firebox, by virtue of the horizontally adjustable heat exchanger tube feature. Forced air driven into the ingress port 35, is heated by conduction and radiation through the front surface 32 of the plenum 30 and is uniformally driven through the plurality of egress ports 38.

A forced air blower 50, connected by means of the tube 48 to the ingress port 35 of the plenum 30. The forced air blower 50 can have a flow rate capacity of approximately 500 cu. ft. per minute maximum, with an adjustable speed switch for reducing the air flow in accordance with comfort. The forced air blower draws air from the ambient and introduces it via the tube 48 into the lower chamber 42 of the plenum 30.

It is seen that, while it is more convenient to introduce the forced air from the tube 48 into the lower chamber 42 through the front surface 32, the invention should not be construed as being limited to this implementation but that, for example, the ingress port 35 and nipple 36 could be located on one of the side surfaces 37 or 39, on the back of surface 33 or on the bottom 31 of the plenum 30.

A plurality of heat exchanger tubes 54 are attached to respective ones of the forced egress ports 38 and extend forwardly from the plenum 30 across the throat 8 of the fireplace with the opposite end 60, thereof directing forced air out of the tube 54, past the lintel 6 and into the ambient 90. The forced air in the tube 54 is heated by means of conduction, convection and radiation from the combustion gases flowing from the fire in the firebox 4, up into the throat 8 of the fireplace. The preferred cross sectional shape of the heat exchanger tubes 54 is circular, thereby permitting a relatively unimpeded flow of the combustion gases into the throat 8, consistent with a maximum heat exchange between the gases and the forced air within the tube 54. The composition of the heat exchanger tubes 54 can be of any material which is heat resistant and has a good thermal conductivity such as sheet metal, copper or brass. The ability of the tube wall to absorb radiant heat can be enhanced by coating the tube 54 with a substance to enhance the thermal emissivity thereof, as for example black stove paint.

The heat exchanger tube 54 has an approximate 90° bend 56 at the end 58 thereof. This enables the tube 54 to be conveniently mounted on top of the top surface 34 of the plenum 30 surrounding the nipple 40 of the egress port 38. The end 58 of the tube 54 could be caulked into position on top of surface 34, with furnace cement. However, to make the assembly universally adaptable to a variety of sizes of existing fireplaces, the end 58 of the tube 54 is pivotally mounted over the nipple 40, thereby permitting angular motion of the tube 54 about a substantially vertical axis centered in the egress port 38. This angular motion permits the forced air emitted from the end 60 of the tube 54 to be selectively directed into the ambient 90. In addition, access is thereby permitted to the throat of the fireplace for adjustment of the damper handle 14 or for maintenance where required.

Figure 3:
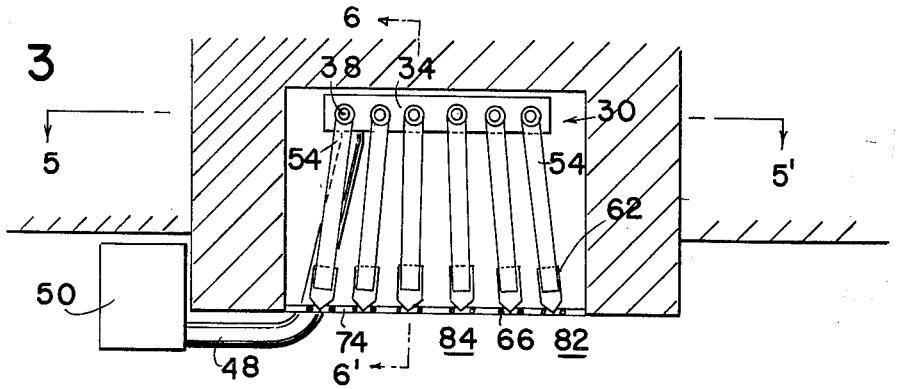
FIG. 3 is a cross sectional view at 3–3′ of FIG. 2, showing the relative placement of the universal fireplace heater in the firebox.
Figure 4:
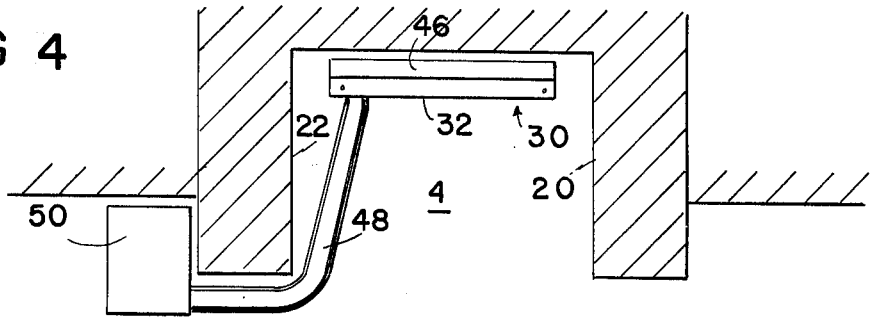
FIG. 4 is a cross sectional view at 4–4′ of FIG. 2, showing the arrangement of the baffles within the plenum of the universal fireplace heater.
Figure 6:
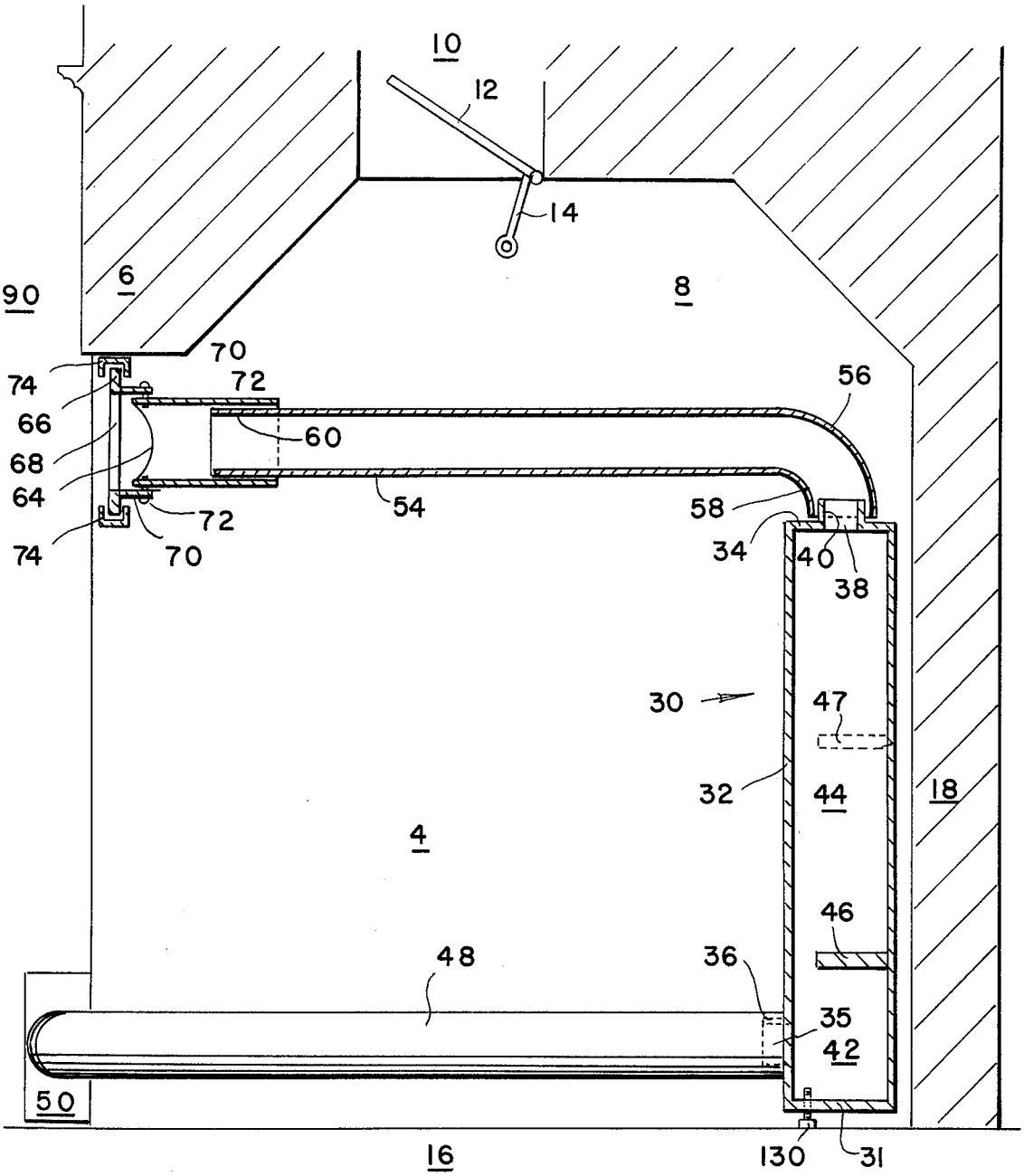
FIG. 6 is a cross sectional view of the plenum and heat exchanger tube assembly along the line 6–6′ of FIG. 3, showing in more detail the pivotal mounting of the heat exchanger tube on the egress port of the plenum and the slidable engagement of the heat exchanger tube with the sleeve and plate assembly beneath the lintel.

The end 60 of the tube 54 slidably engages a sleeve 62 and plate assembly 66 shown in FIG. 6. This slidable engagement permits installation of the apparatus into a firebox 4 having an arbitrary depth. The sleeve and plate assembly is, in turn, slidably engaged in a frame 74 shown in detail in FIG. 7, which is attached beneath the lintel 6. Detailed illustrations of the sleeve and plate assembly are shown in FIGS. 3, 6, and 8. The sleeve 62 has an inner diameter slightly larger than the outer diameter of the end 60 for the tube 54, to permit slidable engagement therewith. The end 64 of the sleeve 62 is pivotally attached to the tabs 70 of the plate 66 by means of the screws 72 to permit angular motion of the sleeve with respect to the plate about a substantially vertical axis. The plate 66 is perforated by a hole 68 having an inner diameter slightly larger than the outer diameter of the sleeve 62. The hole 68 is juxtaposed in a substantially coaxial relationship with the sleeve 62 whereby forced air emitted from the end 60 of the tube 54 is conducted by the sleeve 62 through the end 64 so as to be emitted through the hole 68 of the plate 66 into the ambient 90. As is seen from an examination of FIG. 3, the slidable engagement of the end 60 for the tube 54 with the sleeve 62, the pivotal mounting of the tube 54 over the egress port 38 of the plenum 30, and the pivotal mounting of the sleeve 62 to the tabs 70 on the plate 66, all combine to permit a fully adjustable heat exchanger tube assembly, wherein complete freedom of position is possible in the horizontal position for the end 60 of the tube 54. This freedom of position permits the universal installation of the assembly in a variety of sizes of fireplaces, and in each application the horizontal position of the end 60 of the heat exchanger tube 54 can be placed so as to optimally extract heat from the combustion gases in the throat of the fireplace while at the same time selectively direct the heated, forced air emitted from the assembly. This free horizontal positioning feature is shown to advantage in FIG. 3 which illustrates a first position 82 for a heat exchanger tube, sleeve, and plate assembly oriented at an acute angle with respect to the front surface 32 of the plenum 30. An alternate position 84 for another heat exchanger tube, sleeve and plate assembly is shown, where the assembly is at a substantially right angle with respect to the front surface 32 of the plenum 30. It is seen that the slidable engagement of the end 60 and the tube 54 in the sleeve 62 takes up the slack between the center of the egress port 38 in the plenum 30 and the center of the hole 68 in the plate 66 when the horizontal position of the plate 66 along the track of the frame 74, is changed.

FIG. 7 is a detailed illustration of the frame 74 showing its adjustable feature for fitting various fireplace widths. The frame 74 is comprised of two halves 74 and 74'. The portion 74' has a smaller external dimension than the internal dimension of the portion 74 so that the portion 74' can adjustably slide within the track formed by the portion 74 as is shown in the cross sectional view of FIG. 7*a*. The frame 74–74' is attached by means of the screw hole 78 to the lintel 6 and by means of the screw holes 80 to the respective sides 20 and 22 of the fireplace.

Figure 5:
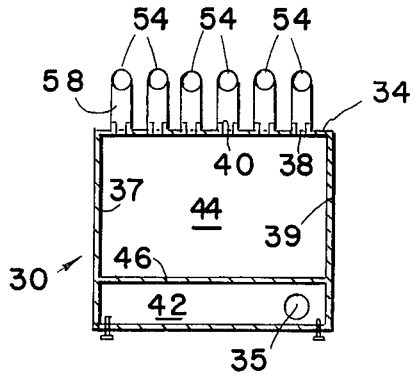
FIG. 5 is a cross sectional view of the plenum taken at 5–5′ of FIG. 3, showing the relative position of the forced air ingress port, the baffles, and the egress ports for the plenum.

The height of the tubes 54 can be adjusted by cutting the length of the end 58 of tube 54, or alternately, adjusting the height of the bottom of plenum 30 by means of threaded supporting bolts 130 shown in FIGS. 5 and 6.

Thus it is seen that the universal fireplace heater can be easily installed in a variety of sizes of fireplaces and the heat exchanger tubes thereof can be adjusted to optimize heat transfer efficiency, selectively direct the heated air, permit easy access to the throat of the fireplace and minimally impede the draft of the combustion gases into the throat of the fireplace consistent with a maximum heat transfer efficiency to the forced air in the system.

Figure 9:
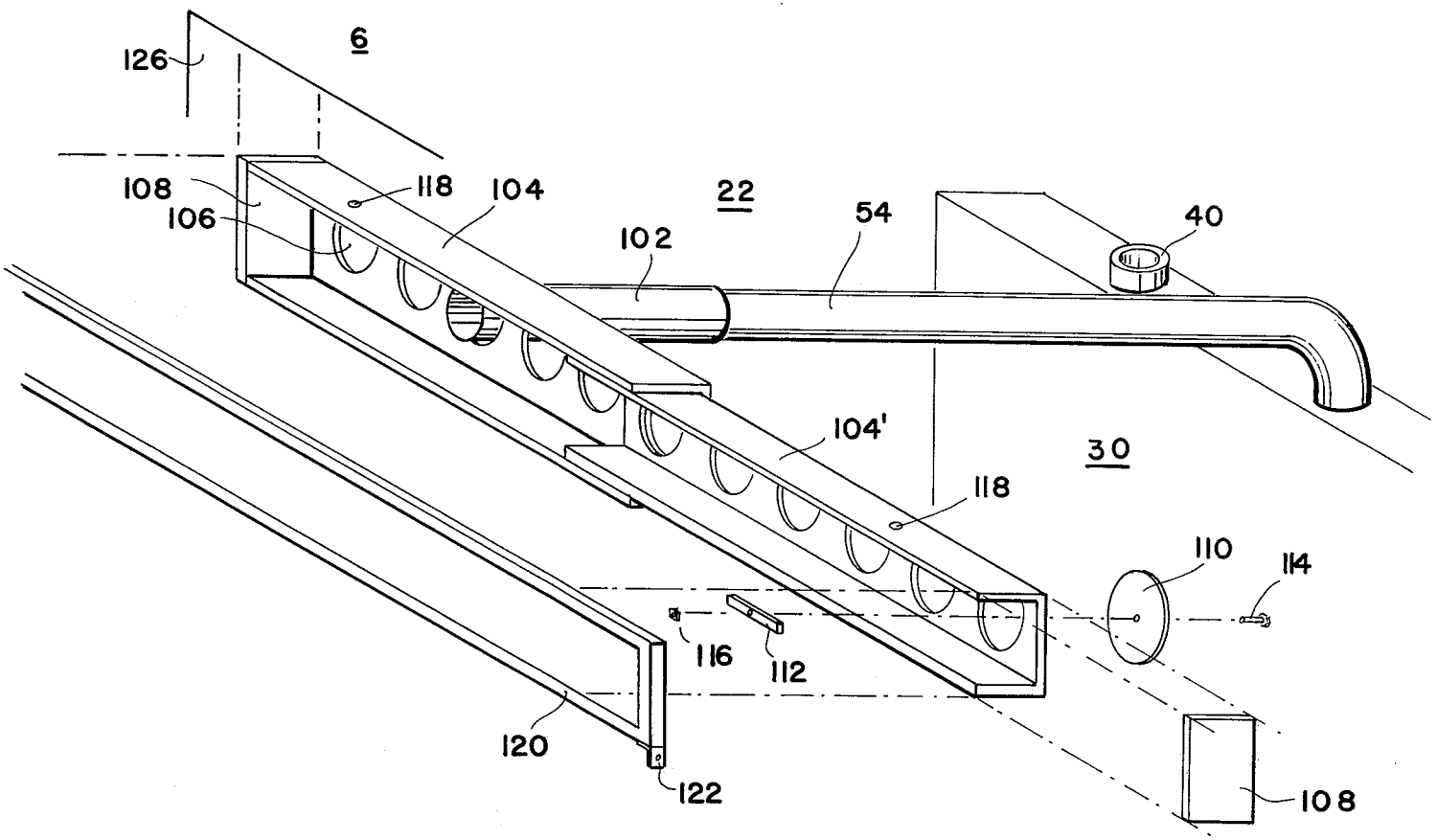
FIG. 9 is an isometric exploded view of an alternate embodiment of the invention which includes the adjustable air chamber 104.
Figure 11:
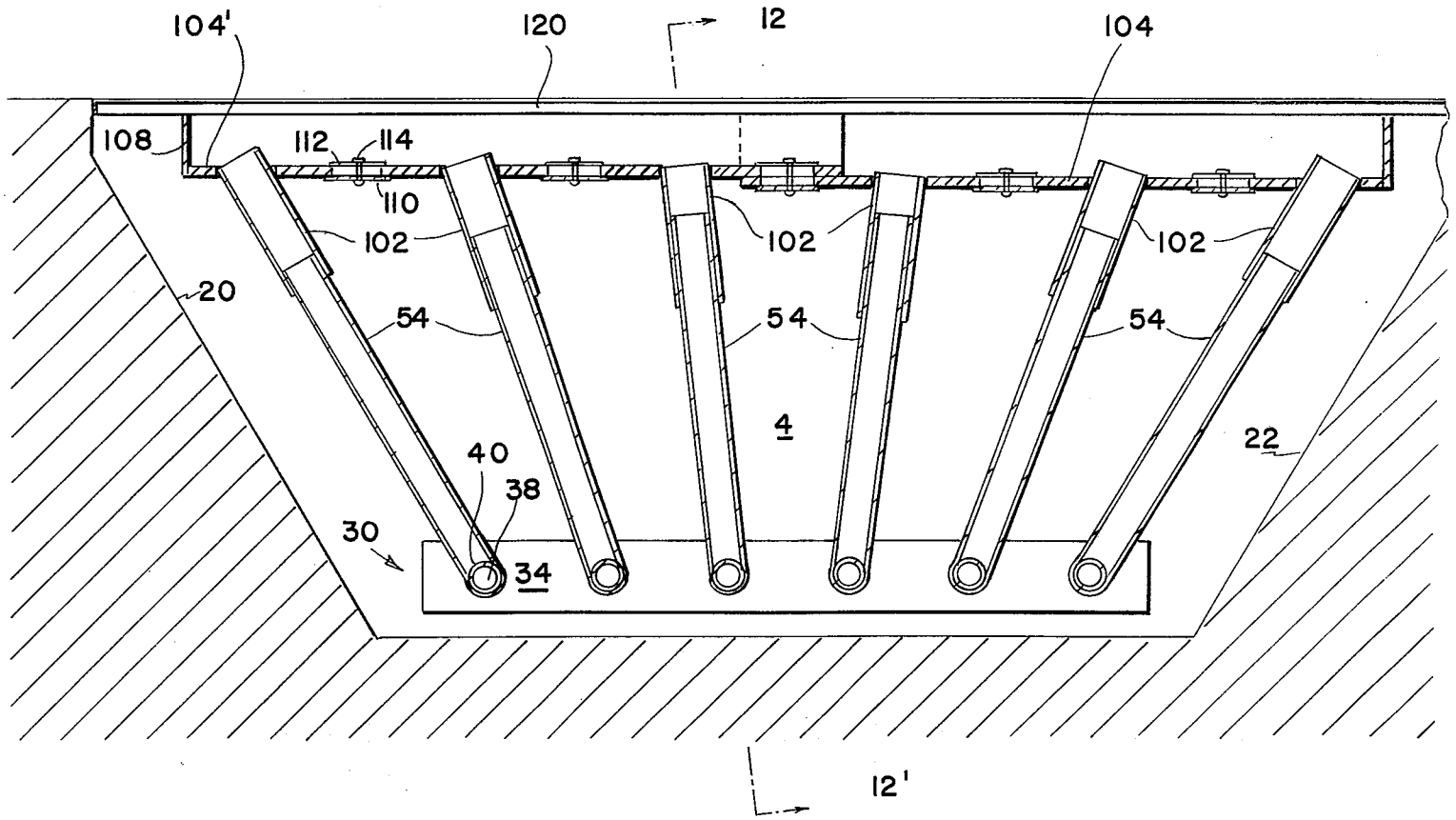
FIG. 11 is a cross sectional view of the alternate embodiment of the invention from the top, taken along 11–11′ of FIG. 11.
Figure 12:
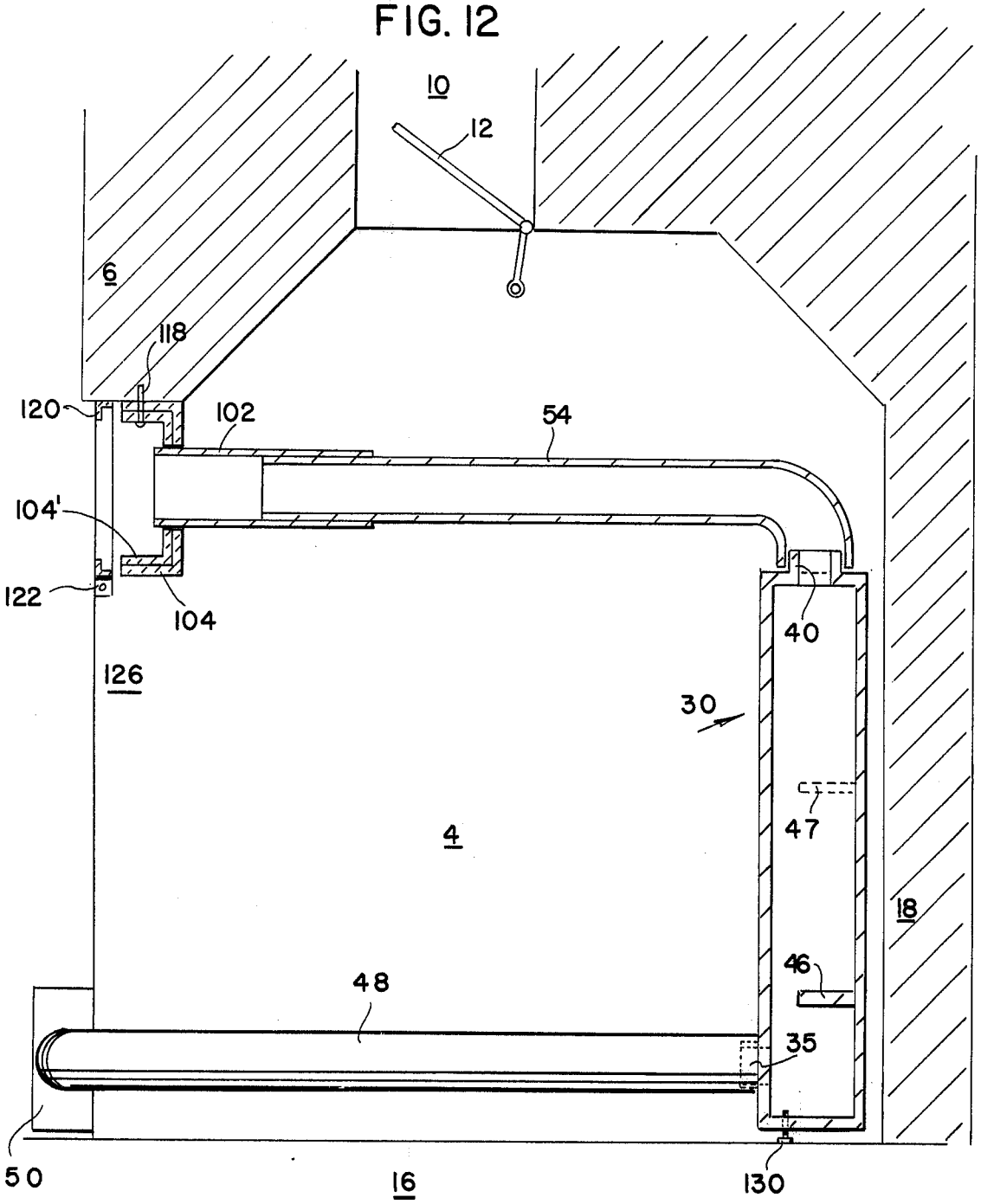
FIG. 12 is a cross sectional view of the alternate embodiment of the invention from the side, taken along 12–12′ of FIG. 11.

FIG. 9 shows an isometric exploded view of an alternate embodiment of the invention which includes the adjustable air chamber 104. FIG. 10 is an elevational front view of a fireplace illustrating how the adjustable air chamber embodiment of the invention appears when it is installed therein. The plenum 30, tube 48, forced air blower 50 and heat exchanger tubes 54 remain the same as was described above. A cylindrical sleeve 102 slidably engages the heat exchanger tube 54.

The adjustable air chamber 104 is composed of 2 sliding portions 104 and 104', each of which has a plurality of holes 106 along its back side, for engagement with the adjustable sleeve 102. The width of the adjustable air chamber can be varied by sliding the member 104' with respect to the member 104 so that the respective holes 106, which are equally spaced within each member, are aligned. The total width of the air chamber can be selected as the widest which will fit in the fireplace having a lintel of a particular width. The adjustable air chamber is attached to the underside of the lintel by means of fasteners such as screws through the holes 118. It is seen that a single size air chamber 104 includes the end caps 108 which serve to seal off air flow otherwise directed out of the ends of the air chamber 104.

After the adjustable air chamber is installed beneath the lintel 6 of the fireplace, heat exchanger tube 54, which is pivotally mounted on the upper surface 34 of the plenum 30, may be selectively positioned in any one of the plurality of holes 106. This is done by sliding the adjustable sleeve 102 in a backward direction on the heat exchanger tube 54, angularly displacing the heat exchanger tube 54 so that its axis coincides with the center of another hole 106, and then forwardly sliding the adjustable sleeve 102 so as to engage the second hole in the air chamber 104. This design permits easy adjustment at the time of installation and the continued ability to adjust the direction of air flow at any time after installation, so as to optimize the air flow directed into the room to be heated. The holes 106 are slightly oversized with respect to the external diameter of the sleeve 102 so as to enable the sleeve 102 to engage a selected hole 106 at an oblique angle.

The plenum 30 may have 6 egress ports 38, for example, and the adjustable air chamber 104 may have 12 or more holes 106 in the back side thereof, for example. Those holes 106 which are not utilized by engagement with a sleeve 102, may be blocked from leaking air by means of the disc 110 which is fastened by means of the strap 112, the screw 114 and the nut 116, into the unused holes 106.

An asthetic screen 120 can be placed over the open side of the air chamber 104 as is shown in FIGS. 9, 10, 11, and 12. The asthetic screen 120 may be mounted by means of the angle brackets 122 to the sides 126 of the fireplace.

Thus it is seen that this adjustable air chamber embodiment of the invention allows for the adjustment of the position of the heat exchanger tubes 54 so as to optimize the direction of flow of air into the room, make maximum utilization of the heat developed within the fireplace 4, and allows for readjustment at any time to accomodate changes in the desired air flow or to gain easy access to the throat of the fireplace.

Although only two embodiments of the invention have been illustrated in the accompanying drawings and described in the foregoing specification, it should be understood by those skilled in the art that various changes such as in the relative dimensions of the parts, materials used, and the like, as well as the suggested manner of the use of the apparatus of the invention may be made therein without departing from the spirit and the scope of the invention.

I claim:

1. A heat exchanger for placement in the firebox of an existing fireplace and increasing the heat output thereof, comprising:

a substantially vertical plenum located in the rear portion of said firebox, with a front surface approximately as wide as said firebox, a top surface having a plurality of forced air egress ports, and a forced air ingress port in the lower portion thereof;

a forced air blower connected to said ingress port for driving ambient air into said plenum;

a plurality of heat exchanger tubes, each tube having a first end connected to one of said plurality of egress ports and extending forwardly from said plenum across the throat of said fireplace with the second end thereof directing said forced air out of said tube and past the lintel of said fireplace and into the ambient;

each said heat exchanger tube further comprising:

a pivotal mounting of each said tubes on respective ones of said egress ports of said plenum, providing for angular motion of said tube about a substantially vertical axis;

said forced air in said plenum being heated by conduction and radiation through said front surface of said plenum and said forced air being further heated in said heat exchanger tubes from the combustion gases in the throat of said fireplace, so as to enhance the heating efficiency of the fireplace;

whereby said forced air may be directed out of said tube in a selected direction and access to the throat of the fireplace is permitted for adjustment of the damper or maintenance.

2. A heat exchanger for placement in the firebox of an existing fireplace and increasing the heat output thereof, comprising:

a substantially vertical plenum located in the rear portion of said firebox, with a front surface approximately as wide as said firebox, a top surface having a plurality of forced air egress ports, and a forced air ingress port in the lower portion thereof;

a forced air blower connected to said ingress port for driving ambient air into said plenum;

a plurality of heat exchanger tubes, each tube having a first end connected to one of said plurality of egress ports and extending forwardly from said plenum across the throat of said fireplace with the second end thereof directing said forced air out of said tube and past the lintel of said fireplace and into the ambient;

said plenum further comprising a nipple at each of said egress ports of said plenum;

each of said heat exchanger tubes being pivotally mounted on said respective nipple, providing for angular motion of said tube about a substantially vertical axis;

whereby said forced air in said plenum is heated by conduction and radiation through said front surface of said plenum and said forced air is further heated in said heat exchanger tubes from the combustion gases in the throat of said fireplace, so as to enhance the heating efficiency of the fireplace.

3. The apparatus of claim 2, which further comprises:

a frame means attached to the lintel of said fireplace, for supporting said second end of said tubes.

4. The apparatus of claim 3, which further comprises:

a perforated plate means slidably engaging said frame means to permit motion of the plate substantially in a horizontal direction parallel to said lintel;

a sleeve means pivotally attached to said plate means and juxtaposed with said perforation therein, providing for angular motion of said sleeve means about a substantially vertical axis;

said tube being coaxial with said sleeve means and in sliding engagement therewith;

whereby said second end of said tube can be displaced in a substantially horizontal direction to selectively direct said forced air into the ambient.

5. A heat exchanger for placement in the firebox of an existing fireplace and increasing the heat output thereof, comprising:

a substantially vertical plenum located in the rear portion of said firebox, with a front surface approximately as wide as said firebox, a top surface having a plurality of forced air egress ports, and a forced air ingress port in the lower portion thereof;

a forced air blower connected to said ingress port for driving ambient air into said plenum;

a plurality of heat exchanger tubes, each tube having a first end connected to one of said plurality of egress ports and extending forwardly from said plenum across the throat of said fireplace with the second end thereof directing said forced air out of said tube and past the lintel of said fireplace and into the ambient;

a baffle means located within said plenum above said ingress port for directing said forced air against said front surface of said plenum;

said plenum further comprising a plurality of nipples, one at each of said egress ports of said plenum;

each of said heat exchanger tubes is pivotally mounted on a respective one of said nipples, providing for angular motion of said tube about a substantially vertical axis;

whereby said forced air in said plenum is heated by conduction and radiation through said front surface of said plenum and said forced air is further heated in said heat exchanger tubes from the combustion gases in the throat of said fireplace, so as to enhance the heating efficiency of the fireplace.

6. The apparatus of claim 5, which further comprises:

an adjustable frame means attached to the lintel of said fireplace, for supporting said second end of said tubes.

7. The apparatus of claim 6, which further comprises:

a perforated plate means slidably engaging said frame means to permit motion of the plate substantially in a horizontal direction parallel to said lintel;

a sleeve means pivotally attached to said plate means and juxtaposed with said perforation therein, providing for angular motion of said sleeve means about a substantially vertical axis;

said tube being coaxial with said sleeve means and in sliding engagement therewith;

whereby said second end of said tube can be displaced in a substantially horizontal direction to selectively direct said forced air into the ambient.

8. A heat exchanger for placement in the firebox of an existing fireplace and increasing the heat output thereof, comprising:

a substantially vertical plenum located in the rear portion of said firebox, with a front surface approximately as wide as said firebox, a top surface having a plurality of forced air egress ports, and a forced air ingress port in the lower portion thereof;

a forced air blower connected to said ingress port for driving ambient air into said plenum;

a plurality of heat exchanger tubes, each tube having a first end connected to one of said plurality of egress ports and extending forwardly from said plenum across the throat of said fireplace with the second end thereof directing said forced air out of said tube and past the lintel of said fireplace and into the ambient;

an air chamber fastened beneath the lintel of the fireplace;

said air chamber having a rearward face with a perforation therein;

said second end of said heat exchanger tube engaging said perforation of said air chamber;

said air chamber further comprising:

a first chamber portion having an open end;

a second chamber portion in slidable engagement with said first chamber portion through said open end;

said air chamber being laterally adjustable so as to fit under the lintels of various sized fireplaces;

whereby said forced air in said plenum is heated by conduction and radiation through said front surface of said plenum and said forced air is further heated in said heat exchanger tubes from the combustion gases in the throat of said fireplace, so as to enhance the heating efficiency of the fireplace.

9. The apparatus of claim 8, wherein said air chamber further comprises:

said air chamber having a rearward side with a plurality of perforations therein, equally spaced in the lateral direction.

10. The apparatus of claim 9, wherein said heat exchanger tube further comprises:

an adjustable sleeve in slidable engagement with said second end of said heat exchanger tube for engagement with one of said perforations in said air chamber;

whereby said heat exchanger tube can be selectively, angularly displaced about a substantially vertical axis at said forced air egress port and said sleeve creates a seal with said air chamber.

11. The apparatus of claim 10 which further comprises:

a clamping disc means in engagement with one of said perforations not in engagement with said sliding sleeve on said heat exchanger tube;

whereby the escape of air from said air chamber is blocked by said clamping disc means.

12. The apparatus of claim 11 which further comprises:

each of said plurality of heat exchanger tubes having a sleeve slidably engaging said second end of said tube and in engagement with one of said perforations in said air chamber;

each of said perforations in said air chamber not in engagement with an adjustable sleeve means, having a clamping disc means in engagement therewith;

whereby the distribution of air flow produced by the apparatus may be adjusted.

* * * * *